US009359821B2

(12) United States Patent
Sauvageau

(10) Patent No.: US 9,359,821 B2
(45) Date of Patent: Jun. 7, 2016

(54) INNER GAUGE RING DRILL BIT

(71) Applicant: National Oilwell Varco, L.P., Houston, TX (US)

(72) Inventor: Richard J. Sauvageau, Conroe, TX (US)

(73) Assignee: National Oilwell Varco, L.P., Houston, TX (US)

( * ) Notice: Subject to any disclaimer, the term of this patent is extended or adjusted under 35 U.S.C. 154(b) by 522 days.

(21) Appl. No.: 13/774,591

(22) Filed: Feb. 22, 2013

(65) Prior Publication Data

US 2013/0228382 A1 Sep. 5, 2013

Related U.S. Application Data

(60) Provisional application No. 61/605,835, filed on Mar. 2, 2012.

(51) Int. Cl.

| | |
|---|---|
| ***E21B 10/04*** | (2006.01) |
| ***E21B 17/10*** | (2006.01) |
| ***E21B 10/60*** | (2006.01) |
| ***E21B 10/08*** | (2006.01) |
| ***E21B 10/14*** | (2006.01) |
| ***E21B 10/42*** | (2006.01) |
| *E21B 10/48* | (2006.01) |

(52) U.S. Cl.

CPC ..... *E21B 10/04* (2013.01); *E21B 10/08* (2013.01); *E21B 10/14* (2013.01); *E21B 10/42* (2013.01); *E21B 10/60* (2013.01); *E21B 17/1092* (2013.01); *E21B 10/48* (2013.01)

(58) Field of Classification Search

CPC ..... E21B 10/14; E21B 10/26; E21B 10/28; E21B 10/00; E21B 10/04

See application file for complete search history.

(56) References Cited

U.S. PATENT DOCUMENTS

| | | | | |
|---|---|---|---|---|
| 2,708,103 | A | 5/1955 | Williams, Jr. | |
| 2,975,849 | A * | 3/1961 | Stuart | E21B 10/04 175/107 |
| 3,100,544 | A | 8/1963 | Overly et al. | |
| 3,743,036 | A | 7/1973 | Feenstra et al. | |
| 4,527,644 | A | 7/1985 | Allam | |
| 5,016,718 | A * | 5/1991 | Tandberg | E21B 10/04 175/333 |
| 6,006,844 | A | 12/1999 | Van Puymbroeck et al. | |
| 8,201,642 | B2 * | 6/2012 | Radford et al. | 175/262 |
| 2012/0273275 | A1 | 11/2012 | Broussard, Jr. | |

FOREIGN PATENT DOCUMENTS

| | | |
|---|---|---|
| GB | 2110746 | 6/1983 |

OTHER PUBLICATIONS

International Preliminary Report on Patentability dated Jun. 23, 2014 for corresponding International Application No. PCT/US2013/027458 (20 pgs.).

Search Report and Written Opinion dated Feb. 11, 2014 for corresponding International Application No. PCT/US2013/027458 (13 pgs.).

Office Action dated Jun. 30, 2015 for corresponding Australian Application No. 2013226327.

* cited by examiner

*Primary Examiner* — Brad Harcourt

(74) *Attorney, Agent, or Firm* — Derek V. Forinash; Porter Hedges LLP

(57) ABSTRACT

A drill bit comprises a plurality of annular blades coupled to a bit body. A plurality of gauge pads is coupled to the bit body and defines an outer cutting diameter. A circumferentially continuous gauge ring is coupled to the bit body and defines an inner cutting diameter. An inner cutting structure is coupled to the bit body and has a cutting diameter substantially equal to the inner cutting diameter.

17 Claims, 4 Drawing Sheets

INNER GAUGE RING DRILL BIT

CROSS-REFERENCE TO RELATED APPLICATIONS

This application claims priority to U.S. patent application Ser. No. 61/605,835, titled Inner Gauge Ring Drill Bit, which was filed Mar. 2, 2012, which is hereby incorporated by reference in their entirety into the present application, to the extent that it is not inconsistent with the present application.

BACKGROUND

This disclosure relates generally to rotary earth-boring drill bits. More particularly, this disclosure relates to a combination drill bit that includes an inner gauge ring that stabilizes the drill bit.

Rotary drill bits are typically mounted on the lower end of a drill string that is being rotated from the surface or by downhole motors. As the drill string is rotated, tension is applied to the drill string to control the weight on the bit so that the bit engages and drills a borehole into the earthen formation.

Two types of available drill bits are roller cone bits and fixed cutter bits. Roller cone bits often include a plurality of conical rollers that rotatably mounted to the bit and imbedded with a plurality of cutting elements. Fixed cutter bits rely on a plurality of fixed blades angularly spaced about the bit and imbedded with a plurality of cutting elements. The cutting elements for either bit design are often formed from extremely hard materials such as polycrystalline diamond material, cubic boron nitride, and tungsten carbide. The configuration or layout of the rollers, blades, and cutter elements vary widely between bit designs depending heavily on the formation to be drilled.

While the bit is rotated, drilling fluid is pumped through the drill string and directed out of the face of the drill bit through one or more nozzles. The drilling fluid acts to cool the bit and remove formation cuttings from the bit face and the bottom of the borehole. During the drilling of a borehole, the drill bit will occasionally become worn out and have to be replaced. Each time the bit is replaced, the entire drill string, which may be thousands of feet long, must be retrieved from the borehole and then reinserted once a new bit has been installed. This process, known as a "trip," can take many hours to complete. Therefore, it is desirable to employ drill bits which can drill longer distances before needing to be replaced.

The length of time that a drill bit may be used before it must be changed is highly dependent on wear and/or damage to the cutting elements of the drill bit. One of the factors that can cause excessive wear and damage to cutting elements is bit instability. Bit instability can create vibrations that result in impact loads on the cutting elements, which can cause excessive wear or even break cutting elements. Improving bit stability can reduce the likelihood of the high impact loads and improve the life of a drill bit.

Thus, there is a continuing need in the art for rotary drill bits that provide enhanced stability so as to overcome these and other limitations of the prior art.

BRIEF SUMMARY OF THE DISCLOSURE

In certain embodiments, a drill bit comprises a plurality of annular blades coupled to a bit body. A plurality of gauge pads is coupled to the bit body and defines an outer cutting diameter. A circumferentially continuous gauge ring is coupled to the bit body and defines an inner cutting diameter. An inner cutting structure is coupled to the bit body and has a cutting diameter substantially equal to the inner cutting diameter.

In some embodiments, a drill bit comprises an annular cutting structure having an outer cutting diameter and an inner cutting diameter. An inner cutting structure is recessed within the annular cutting structure and has a cutting diameter substantially equal to the inner cutting diameter. An outer gauge surface has a diameter substantially equal to the outer cutting diameter. A circumferentially continuous gauge ring has a diameter substantially equal to the inner cutting diameter.

In some embodiments, a drill bit comprises a bit body having a plurality of annular blades and a plurality of gauge pads. The plurality of gauge pads defines an outer cutting diameter. A circumferentially continuous inner gauge ring is coupled to the plurality of annular blades and the inner gauge ring defines an inner cutting diameter. An inner cutting structure is coupled to the bit body and has a cutting face that is recessed from a cutting face of the plurality of annular blades. The inner cutting structure also has a cutting diameter substantially equal to the inner cutting diameter.

These and other embodiments and potential advantages will be apparent in the following detailed description and drawings.

BRIEF DESCRIPTION OF THE DRAWINGS

For a more detailed description of the embodiments of the present disclosure, reference will now be made to the accompanying drawings.

DETAILED DESCRIPTION

Figure 1:
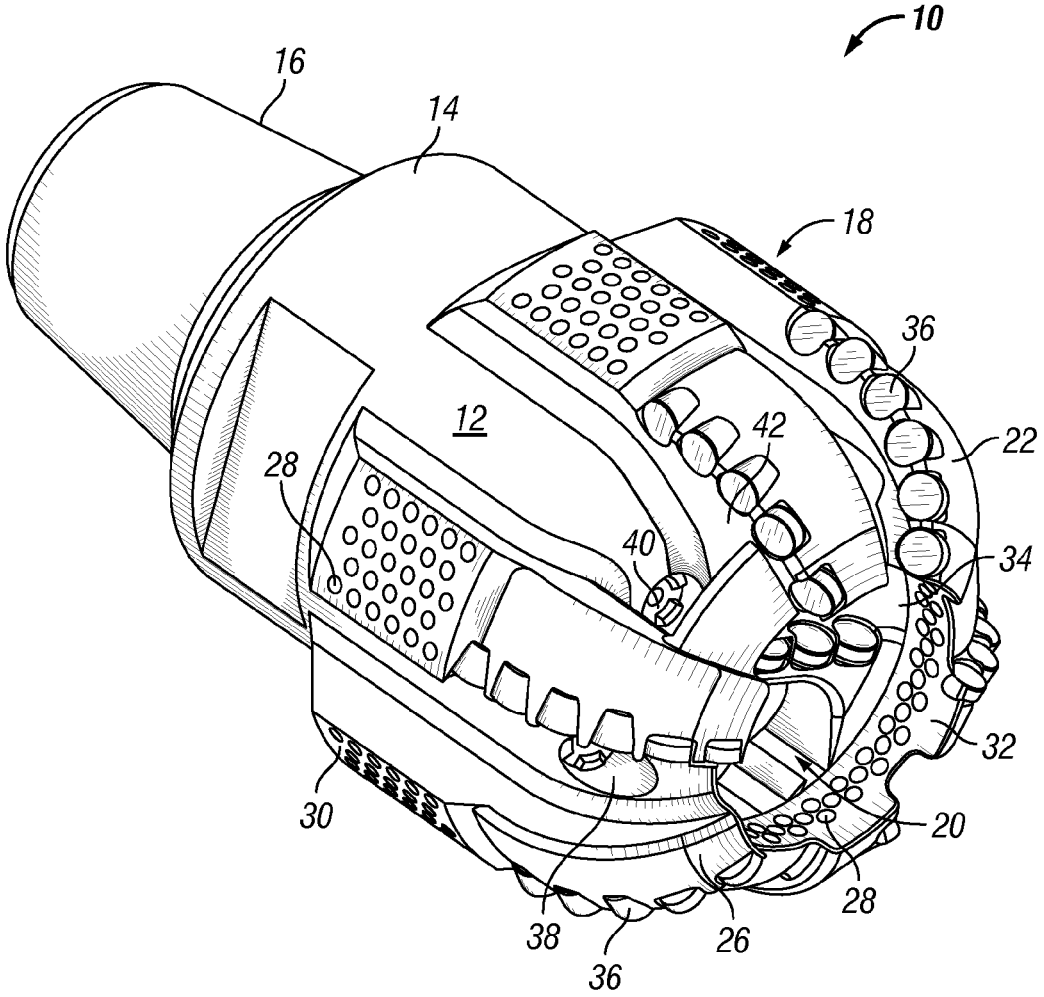
FIG. 1 is a perspective view of a unitary drill bit having an inner gauge ring.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. For the purposes of this application, the term "real-time" means without significant delay.

Figure 2:
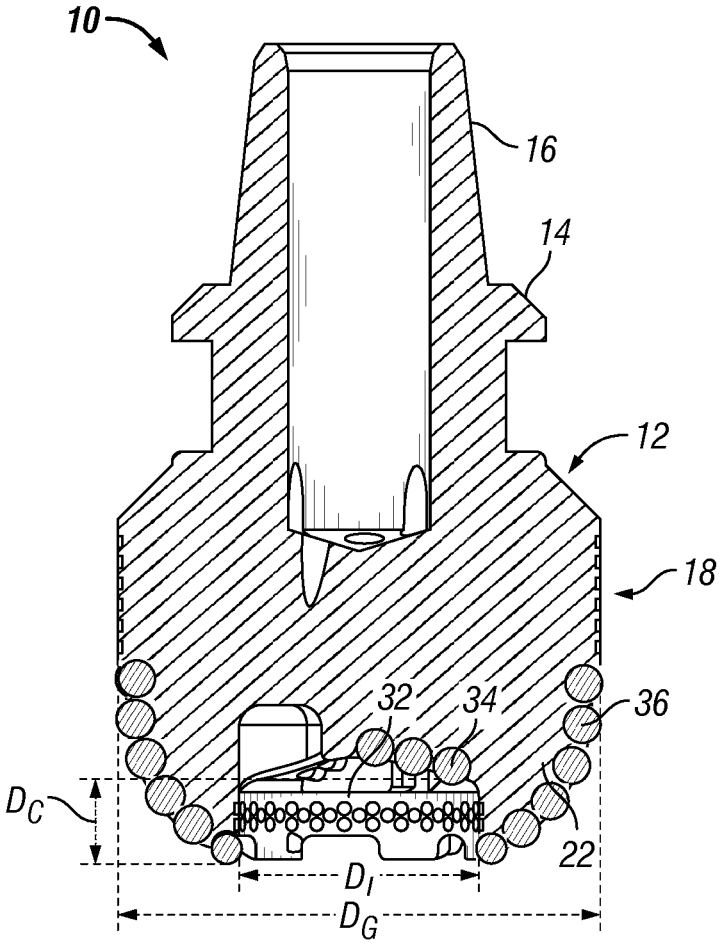
FIG. 2 is a cross-sectional elevation view of the drill bit of FIG. 1.
Figure 3:
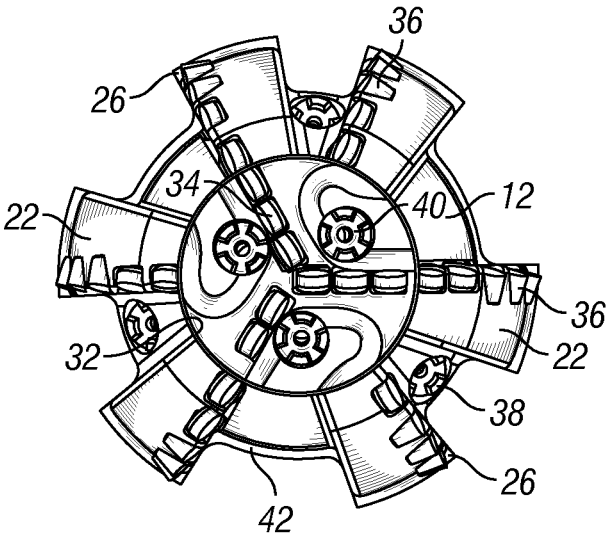
FIG. 3 is an end view of the drill bit of FIG. 1.

Referring initially to FIGS. 1-3, a drill bit 10 includes a bit body 12, shank 14, and a threaded connection 16 for coupling to a drill string. The bit body 12 includes an annular cutting structure 18 that cuts an annular outer portion of a wellbore and a recessed inner cutting structure 20 that cuts the inner core of the wellbore. The annular cutting structure 18 includes a plurality of annular blades 22 extending from and integrally formed with bit body 12. Each annular blade 22 includes a cutting face 26. Outer gauge pads 30, having an outer cutting diameter Dg, are positioned at the maximum outside diameter of the cutting face 26. The outer cutting diameter Dg also defines the diameter of the wellbore being drilled.

An inner gauge ring 32, having an inner cutting diameter $D_i$, defines the inner diameter of the cutting face 26. The inner cutting structure 20 includes a plurality of inner blades 34 that have a cutting diameter substantially equal to the inner cutting diameter $D_i$ of the annular blades 22. Therefore, as the drill bit 10 is rotated and advanced through a formation, the annular cutting structure 18 cuts away an annular portion of the formation with a diameter of $D_g$ and leaves a center core having a diameter of $D_i$ that is then cut by the inner cutting structure 20.

As the center core is drilled, it is engaged by the inner gauge ring 32, which forms a circumferentially continuous ring. The inner gauge ring 32 thus interconnects and supports the annulus blades 22 and defines the entrance to the inner cutting structure 20. The continuous circumferential engagement of the inner gauge ring 32 and the center core minimizes lateral movement of the drill bit 10 relative to the core and helps to stabilize the drill bit 10 within the wellbore. The inner cutting structure 20 includes a plurality of inner blades 34 formed integral with bit body 12 that remove the center core as the drill bit 10 continues to move through the formation, thus leaving a cylindrical wellbore with a diameter $D_g$.

As shown in FIG. 2, the inner gauge ring 32 defines an inner cutting diameter $D_i$, the Outer gauge pads 30 defines an outer cutting diameter of $D_g$, and the inner cutting structure 20 is recessed into bit body 12 a distance $D_c$ from the cutting face of the annular cutting structure. In certain embodiments the ratio of $D_i/D_g$ may be from about 0.25 to about 0.75 and the ratio of $D_i/D_c$ may be from about 3 to about 0.25. For example, an exemplary drill bit 10 may have an outer cutting diameter $D_g$ of about 8.75", and inner cutting diameter $D_i$ of about 4.5" and a recessed distance $D_c$ of about 2".

The annular blades 22 and inner blades 34 include a plurality of hardened cutting elements 36 that engage and cut away the formation as the drill bit 10 is rotated. The hardened cutting elements 36 may be formed from materials including polycrystalline diamond material, cubic boron nitride, thermally stable diamond, polycrystalline cubic boron nitride, or tungsten carbide.

Outer gauge pads 30 and inner gauge ring 32 are sized to directly contact the formation as the wellbore is being drilled and may therefore also include embedded wear-resistant inserts 28 or may be treated to have wear-resistant properties, such as hardfacing. The wear-resistant inserts 28 may include polycrystalline diamond material, cubic boron nitride, thermally stable diamond, polycrystalline cubic boron nitride, or tungsten carbide. The inserts 28 may extend from the inner gauge ring 32 and/or outer gauge pads 30 or may be flush with the outer surface of the outer gauge pads 30 or the inner surface of the inner gauge ring 32. In either condition, the contact surfaces of the inserts 28 may be ground flush with the surrounding surface or may have a rounded, pointed, angled, or other shape.

Drill bit 10 also includes annular nozzles 38 and inner nozzles 40 that serve to inject drilling fluid from the drill pipe into the wellbore through the drill bit. The nozzles 38, 40 are placed so as to cool the drill bit and remove formation cuttings from around the drill bit. Annular nozzles 38 are disposed between every other pair of adjacent annular blades 22. Inner nozzles 40 are disposed adjacent to each inner blade 34.

Bit body 12 also includes junk slots 42 that provide a fluid conduit for drilling fluid and formation cuttings to move from the inner cutting structure 20 and the outer surface of the drill bit 10. Junk slots 42 are disposed between two adjacent annular blades 22 and at a location that does not interrupt the circumferentially continuous inner gauge ring 32. The junk slots 42 are also arranged so that fluid flowing through the junk slots helps to clean the annular blades 22.

Figure 4:
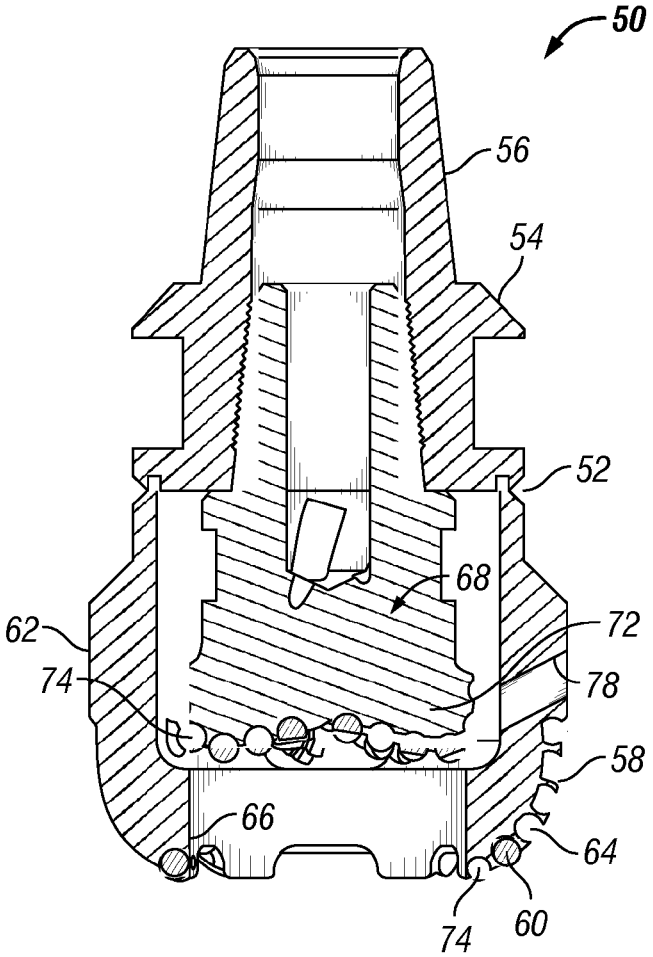
FIG. 4 is a cross-sectional elevation view of combination fixed cutter drill bit having an inner gauge ring.
Figure 5:
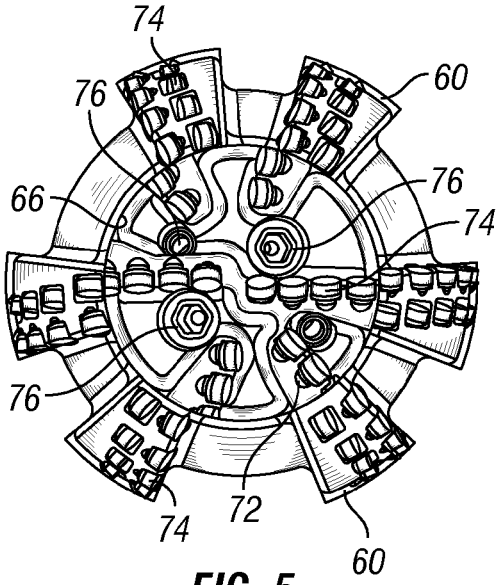
FIG. 5 is an end view of the drill bit of FIG. 4.

Referring now to FIGS. 4-5, a drill bit 50 includes an outer bit body 52, a recessed inner bit body 68, shank 54, and a threaded connection 56 for coupling to a drill string. The outer bit body 52 includes an annular cutting structure 58 including a plurality of annular blades 60 extending from and integrally formed with outer bit body 52. Each annular blade 60 includes a cutting face 64 defined by outer gauge pads 62 and an inner gauge ring 66. As the drill bit 50 is rotated and advanced through a formation, the annular cutting structure 58 cuts away an annular portion of the formation leaving a center core. An inner gauge ring 66 forms a circumferentially continuous ring that interconnects and supports the annular blades 60 and engages the center core. The engagement of the inner gauge ring 66 and the center core minimizes lateral movement of the drill bit 50 relative to the core and helps to stabilize the drill bit 50 within the wellbore.

The recessed inner bit body 68 is disposed within the outer bit body 52 and is positioned so as to drill the center core as the drill bit 50 is advanced through the formation. In certain embodiments, the inner bit body 68 may be releasably coupled to the outer bit body 52, such as by a threaded connection, so that the inner bit body 68 can be removed from the outer bit body 52 and replaced with another inner bit body as desired. In this manner, the inner bit body 68 can be selected based on the formation being drilled and can be a roller cone bit, a fixed cutter bit, a combination thereof, or any type bit as desired.

In the example shown in FIGS. 4-5, the inner bit body 68 includes a plurality of inner blades 72 formed integral therewith. The inner bit body 68 also includes nozzles 76 that serve to inject drilling fluid through the drill bit. The nozzles 76 are placed so as to cool the drill bit and remove formation cuttings from around the drill bit. The cutting faces 64 of the annular blades 60 and inner blades 72 each include a plurality of hardened cutting elements 74 that engage and cut away the formation as the drill bit 50 is rotated. The hardened cutting elements 74 may be formed from materials including polycrystalline diamond material, cubic boron nitride, thermally stable diamond, polycrystalline cubic boron nitride, or tungsten carbide.

Outer gauge pads 62 and inner gauge ring 66 each are sized to directly contact the formation as the wellbore is being drilled and may therefore also include embedded wear-resistant inserts or may treated to have wear-resistant properties, such as hardfacing. The wear-resistant inserts may include polycrystalline diamond material, cubic boron nitride, thermally stable diamond, polycrystalline cubic boron nitride, or tungsten carbide.

Outer bit body 52 also includes junk slots 78 that provide fluid communication across the outer bit body. Junk slots 78 are disposed so as not to interrupt the continuous inner gauge ring 66. The junk slots 78 provide a pathway for drilling fluid to move from the nozzles 76 to the outside of the drill bit 50.

Figure 6:
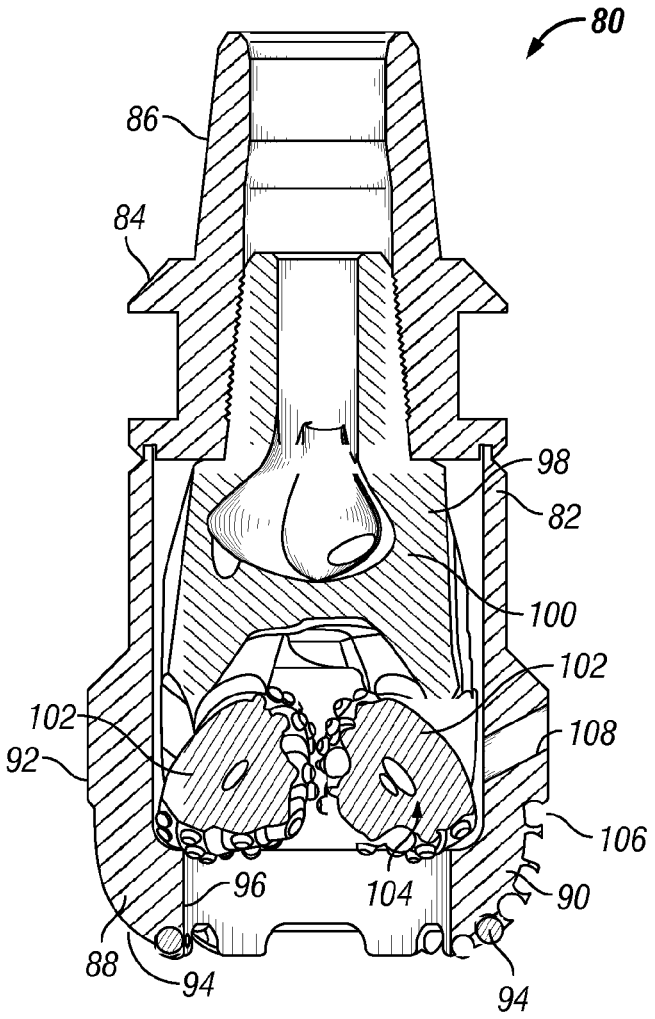
FIG. 6 is a cross-sectional elevation view of a combination roller cone drill bit having an inner gauge ring.
Figure 7:
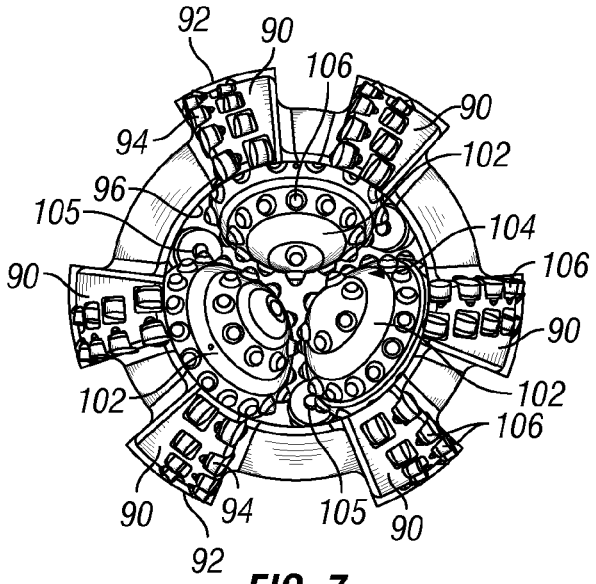
FIG. 7 is an end view of the drill bit of FIG. 6.

FIGS. 6-7 illustrate an alternative drill bit 80 that includes an outer bit body 82 surrounding a recessed inner cutting structure 98 having a plurality of roller cones 102 forming an inner cutting structure 104. The outer bit body 82 also includes a shank 84, and a threaded connection 86 for coupling to a drill string. The outer bit body 82 includes an annular cutting structure 88 including a plurality of annular blades 90 extending from and integrally formed with bit body 82. Each annular blade 90 includes a cutting face 94 defined by outer gauge pads 92 and an inner gauge ring 96.

As the drill bit 80 is rotated and advanced through a formation, the annular cutting structure 88 cuts away an annular portion of the formation leaving a center core that passes through an inner gauge ring 96 into the bit body 82 where the core is then drilled by the inner cutting structure 104. The inner gauge ring 96 forms a circumferentially continuous ring that interconnects and supports the annular blades 90 and engages the center core. The engagement of the inner gauge ring 96 and the center core minimizes lateral movement of the drill bit 80 relative to the core and helps to stabilize the drill bit 80 within the wellbore.

The inner cutting structure 98 includes an inner bit body 100 that rotatably supports a plurality of roller cones 102. The inner bit body 100 also includes nozzles 105 that serve to inject drilling fluid through the drill bit. The nozzles 105 are placed so as to cool the drill bit and remove formation cuttings from around the drill bit.

The annular blades 90 and roller cones 102 include a plurality of hardened cutting elements 106 that engage and cut away the formation as the drill bit 80 is rotated. The hardened cutting elements 106 may be formed from materials including polycrystalline diamond material, cubic boron nitride, thermally stable diamond, polycrystalline cubic boron nitride, or tungsten carbide.

Outer gauge pads 92 and inner gauge ring 96 are sized to directly contact the formation as the wellbore is being drilled and may therefore also include embedded wear-resistant inserts or may treated to have wear-resistant properties, such as hardfacing. The wear-resistant inserts may include polycrystalline diamond material, cubic boron nitride, thermally stable diamond, polycrystalline cubic boron nitride, or tungsten carbide.

Outer bit body 82 also includes junk slots 108 that provide fluid communication across the outer bit body. Junk slots 108 are disposed so as not to interrupt the continuous inner gauge ring 96 and provide a pathway for drilling fluid to move from the nozzles 105 to the outside of the drill bit 80.

Similar to the embodiments illustrated in FIGS. 4-5, the inner bit body 100 may be releasably coupled to the outer bit body 82, such as by a threaded connection, so that the inner bit body 100 can be removed from the outer bit body 82 and replaced with another inner bit body as desired. In this manner, the inner cutting structure 98 can be selected based on the formation being drilled and can be a roller cone bit, a fixed cutter bit, a combination thereof, or any type bit as desired.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A drill bit comprising:

a bit body, including an outer bit body and an inner bit body rotationally secured to the outer bit body, wherein the outer bit body surrounds the inner bit body;

a plurality of annular blades coupled to the outer bit body;

a plurality of gauge pads coupled to the outer bit body and defining an outer cutting diameter;

a circumferentially continuous gauge ring coupled to the outer bit body and defining an inner cutting diameter, wherein the plurality of annular blades includes a cutting face that extends from the outer cutting diameter to the inner cutting diameter;

an inner cutting structure formed on the inner bit body and recessed into the outer bit body, wherein the inner cutting structure has a maximum diameter substantially equal to the inner cutting diameter; and a junk slot disposed across the outer bit body between two adjacent annular blades, wherein the junk slot provides a conduit to move formation cuttings from the inner cutting structure to an outer surface of the bit body.

2. The drill bit of claim 1, wherein the ratio of the inner cutting diameter divided by the outer cutting diameter is between 0.25 and 0.75.

3. The drill bit of claim 1, wherein the inner cutting structure has a cutting face that is recessed a recessed distance from a cutting face of the annular blades.

4. The drill bit of claim 3, wherein the ratio of the inner cutting diameter divided by the recessed distance is between 0.25 and 3.

5. The drill bit of claim 1, wherein the inner cutting structure comprises a plurality of blades.

6. The drill bit of claim 1, wherein the inner cutting structure comprises a plurality of roller cones.

7. A drill bit comprising:

an inner bit body recessed within an outer bit body, wherein the inner bit body is releasably threaded to the outer bit body, and wherein the inner bit body is surrounded by the outer bit body;

an annular cutting structure formed on the outer bit body and having an outer cutting diameter and an inner cutting diameter, wherein the annular cutting structure comprises a plurality of blades extending from the outer bit body, and a plurality of junk slots each disposed across the outer bit body between adjacent annular blades, wherein the junk slots provide a conduit to move formation cuttings from the inner cutting structure to an outer surface of the outer bit body;

an inner cutting structure formed on the inner bit body and having a maximum diameter substantially equal to the inner cutting diameter;

an outer gauge surface having a diameter substantially equal to the outer cutting diameter; and a circumferentially continuous gauge ring having a diameter substantially equal to the inner cutting diameter.

8. The drill bit of claim 7, wherein the ratio of the inner cutting diameter divided by the outer cutting diameter is between 0.25 and 0.75.

9. The drill bit of claim 7, wherein the inner cutting structure has a cutting face that is recessed a recessed distance from a cutting face of the annular cutting structure.

10. The drill bit of claim 9, wherein the ratio of the inner cutting diameter divided by the recessed distance is between 0.25 and 3.

11. The drill bit of claim 7, wherein the inner cutting structure comprises a plurality of blades.

12. The drill bit of claim 7, wherein the inner cutting structure comprises a plurality of roller cones.

13. A drill bit comprising:

an outer bit body having a plurality of annular blades and a plurality of gauge pads, wherein the plurality of gauge pads define an outer cutting diameter;

a circumferentially continuous inner gauge ring coupled to the plurality of annular blades, wherein the inner gauge ring defines an inner cutting diameter, wherein the plurality of annular blades includes a cutting face that extends from the outer cutting diameter to the inner cutting diameter;

an inner bit body rotationally secured to the outer bit body, wherein the outer bit body surrounds the inner bit body;

an inner cutting structure formed on the inner bit body and having a cutting face that is recessed from the cutting face of the plurality of annular blades, wherein the cutting face of the inner cutting structure has a maximum diameter substantially equal to the inner cutting diameter; and a junk slot disposed through the outer bit body between two adjacent annular blades, wherein the junk slot provides a pathway to move formation cuttings from the cutting face of the inner cutting structure to an outer surface of the outer bit body.

14. The drill bit of claim 13, wherein the ratio of the inner cutting diameter divided by the outer cutting diameter is between 0.25 and 0.75.

15. The drill bit of claim 13, wherein the cutting face of the inner cutting structure is recessed a recessed distance from a cutting face of the annular blades, wherein the ratio of the inner cutting diameter divided by the recessed distance is between 0.25 and 3.

16. The drill bit of claim 13, wherein the inner cutting structure comprises a plurality of blades.

17. The drill bit of claim 13, wherein the inner cutting structure comprises a plurality of roller cones.

* * * * *